US006808431B1

(12) United States Patent
Neely

(10) Patent No.: US 6,808,431 B1
(45) Date of Patent: Oct. 26, 2004

(54) TROLLING MOTOR MOUNT TOOL

(76) Inventor: Joel K. Neely, 1010 Engle Ave., Silsbee, TX (US) 77656

( * ) Notice: Subject to any disclaimer, the term of this patent is extended or adjusted under 35 U.S.C. 154(b) by 0 days.

(21) Appl. No.: 10/417,939

(22) Filed: Apr. 15, 2003

(51) Int. Cl.[7] ..... B63H 1/18
(52) U.S. Cl. ..... 440/63; 440/6
(58) Field of Search ..... 440/6, 53, 63, 440/113; 248/640, 642; 74/524

(56) References Cited

U.S. PATENT DOCUMENTS

| | | | | | |
|---|---|---|---|---|---|
| 3,426,723 | A | * | 2/1969 | Specht | 440/63 |
| 3,648,645 | A | * | 3/1972 | Ezell | 440/63 |
| 3,954,080 | A | | 5/1976 | Weaver | |
| 4,497,413 | A | * | 2/1985 | Tocci | 211/202 |
| 4,604,066 | A | * | 8/1986 | Davatz | 440/7 |
| 4,634,390 | A | * | 1/1987 | Baird | 440/63 |
| 4,735,166 | A | | 4/1988 | Dimalanta | |
| 5,186,428 | A | * | 2/1993 | Falkenberg | 248/284.1 |
| 5,395,271 | A | | 3/1995 | Tyler | |
| 5,405,274 | A | * | 4/1995 | Cook, III | 440/6 |
| 5,453,030 | A | | 9/1995 | Broussard | |
| 5,509,835 | A | | 4/1996 | Henderson et al. | |
| 5,522,578 | A | * | 6/1996 | Mayfield | 248/642 |
| 5,564,956 | A | | 10/1996 | McDavid | |
| 5,573,221 | A | | 11/1996 | Reeves | |
| 5,632,216 | A | | 5/1997 | Hair | |
| 5,725,401 | A | | 3/1998 | Smith | |
| 6,224,437 | B1 | | 5/2001 | Griffith, Sr. et al. | |
| 6,524,144 | B2 | * | 2/2003 | Pasley | 440/6 |

* cited by examiner

*Primary Examiner*—Andrew Wright

(57) ABSTRACT

A trolling motor mount tool for assisting in the moving of a trolling motor support mount between a lowered position and a raised position. The trolling motor mount tool includes a main member having a first cutout and a second cutout, a first arm pivotally attached to the main member, wherein the first arm includes an engaging tube, and a second arm pivotally attached to the main member having an arm cutout. The user utilizes the first cutout and an arm cutout to engage the locking pin of a motor mount for a trolling motor. The user utilizes the second cutout and the engaging tube of the first arm to engage the locking pin of the motor mount.

12 Claims, 6 Drawing Sheets

TROLLING MOTOR MOUNT TOOL

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to trolling motor mounts and more specifically it relates to a trolling motor mount tool for assisting in the moving of a trolling motor support mount between a lowered position and a raised position.

2. Description of the Related Art

Trolling motor mount units have been in use for years. Trolling motor mount units are mounted to the front of a boat for allowing lowering of a trolling motor into the water or removing a trolling motor from the water as illustrated in FIGS. 4 through 6 of the drawings by reference numeral 14. The motor mount illustrated in FIGS. 4 through 6 is similar to the GATOR MOUNT brand trolling motor mount manufactured by MOTORGUIDE (a subsidiary of BRUNSWICK CORPORATION). See www.motorguide.com for additional information about the GATOR MOUNT. The present invention is designed for the GATOR MOUNT brand trolling motor mount, however the present invention may be utilized upon various other brands of trolling motor mounts. A conventional motor mount has two lockable support positions: a lowered position where the trolling motor is positioned within the water and a raised position where the trolling motor is removed from the water. To move from one position to the other, a user must release the locking pin by pulling upon a pull rope or similar mechanism.

The main problem with conventional motor mounts is that the pull ropes often times break thereby making it difficult to manipulate the position of the motor mount. A further problem is that replacing the pull rope can be costly and time consuming. A further problem is that if the pull rope breaks when the motor mount is in the lowered position, the user must remove the entire trolling motor which can be difficult while in the water.

Examples of patented devices which may be related to the present invention include U.S. Pat. No. 5,632,216 to Hair; U.S. Pat. No. 4,735,166 to Dimalanta; U.S. Pat. No. 5,564,956 to McDavid; U.S. Pat. No. 5,573,221 to Reeves; U.S. Pat. No. 5,725,401 to Smith; U.S. Pat. No. 6,224,437 to Griffith, Sr. et al.; U.S. Pat. No. 5,509,835 to Henderson et al.; U.S. Pat. No. 5,453,030 to Broussard; U.S. Pat. No. 5,395,271 to Tyler; and U.S. Pat. No. 3,954,080 to Weaver.

While these devices may be suitable for the particular purpose to which they address, they are not as suitable for assisting in the moving of a trolling motor support mount between a lowered position and a raised position. Trolling motor mount units are prone to pull rope breakage thereby making it difficult to manipulate the positions of the motor mount unit.

In these respects, the trolling motor mount tool according to the present invention substantially departs from the conventional concepts and designs of the prior art, and in so doing provides an apparatus primarily developed for the purpose of assisting in the moving of a trolling motor support mount between a lowered position and a raised position.

BRIEF SUMMARY OF THE INVENTION

In view of the foregoing disadvantages inherent in the known types of trolling motor mounts now present in the prior art, the present invention provides a new trolling motor mount tool construction wherein the same can be utilized for assisting in the moving of a trolling motor support mount between a lowered position and a raised position.

To attain this, the present invention generally comprises a main member having a first cutout and a second cutout, a first arm pivotally attached to the main member, wherein the first arm includes an engaging tube, and a second arm pivotally attached to the main member having an arm cutout. The user utilizes the first cutout and an arm cutout to engage a first locking pin of a motor mount for a trolling motor. The user utilizes the second cutout and the engaging tube of the first arm to engage the second locking pin of the motor mount.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a trolling motor mount tool that will overcome the shortcomings of the prior art devices.

A second object is to provide a trolling motor mount tool for assisting in the moving of a trolling motor support mount between a lowered position and a raised position.

Another object is to provide a trolling motor mount tool that may be utilized upon the GATOR MOUNT brand trolling motor mount manufactured by MOTORGUIDE (a subsidiary of BRUNSWICK CORPORATION).

An additional object is to provide a trolling motor mount tool that is compact in structure for compact storage.

A further object is to provide a trolling motor mount tool that engages the locking pins on a GATOR MOUNT brand trolling motor mount.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
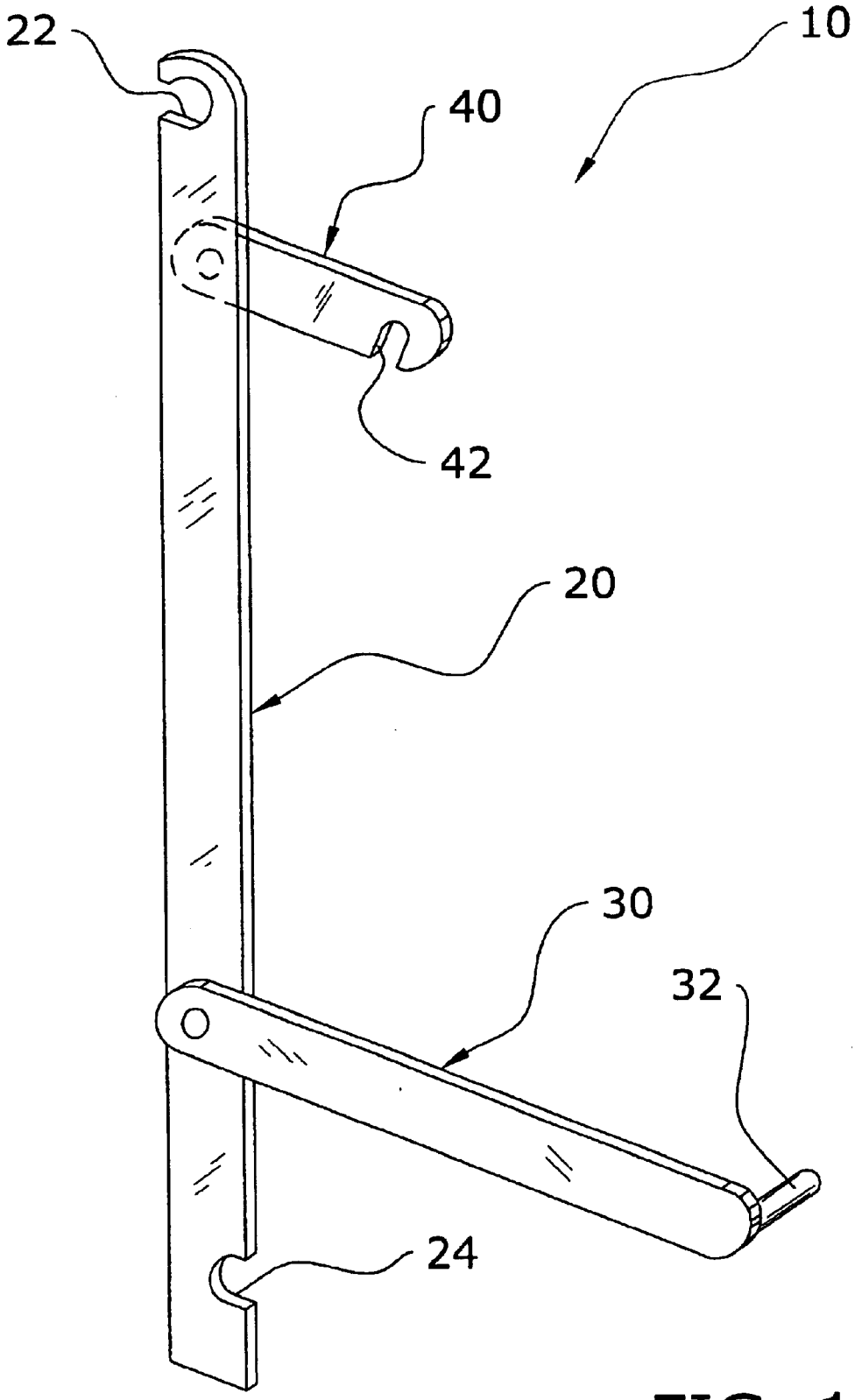
FIG. 1 is an upper perspective view of the present invention.

Turning now descriptively to the drawings, in which similar reference characters denote similar elements throughout the several views, FIGS. 1 through 6 illustrate a trolling motor mount tool 10, which comprises a main member 20 having a first cutout 22 and a second cutout 24, a first arm 30 pivotally attached to the main member 20, wherein the first arm 30 includes an engaging tube 32, and a second arm 40 pivotally attached to the main member 20 having an arm cutout 42. The trolling motor mount tool 10 is particularly suitable for usage upon the GATOR MOUNT brand trolling motor mount manufactured by MOTOR-GUIDE (a subsidiary of BRUNSWICK CORPORATION). However, the trolling motor mount tool 10 may be utilized with various other trolling motor mounts.

Figure 2:
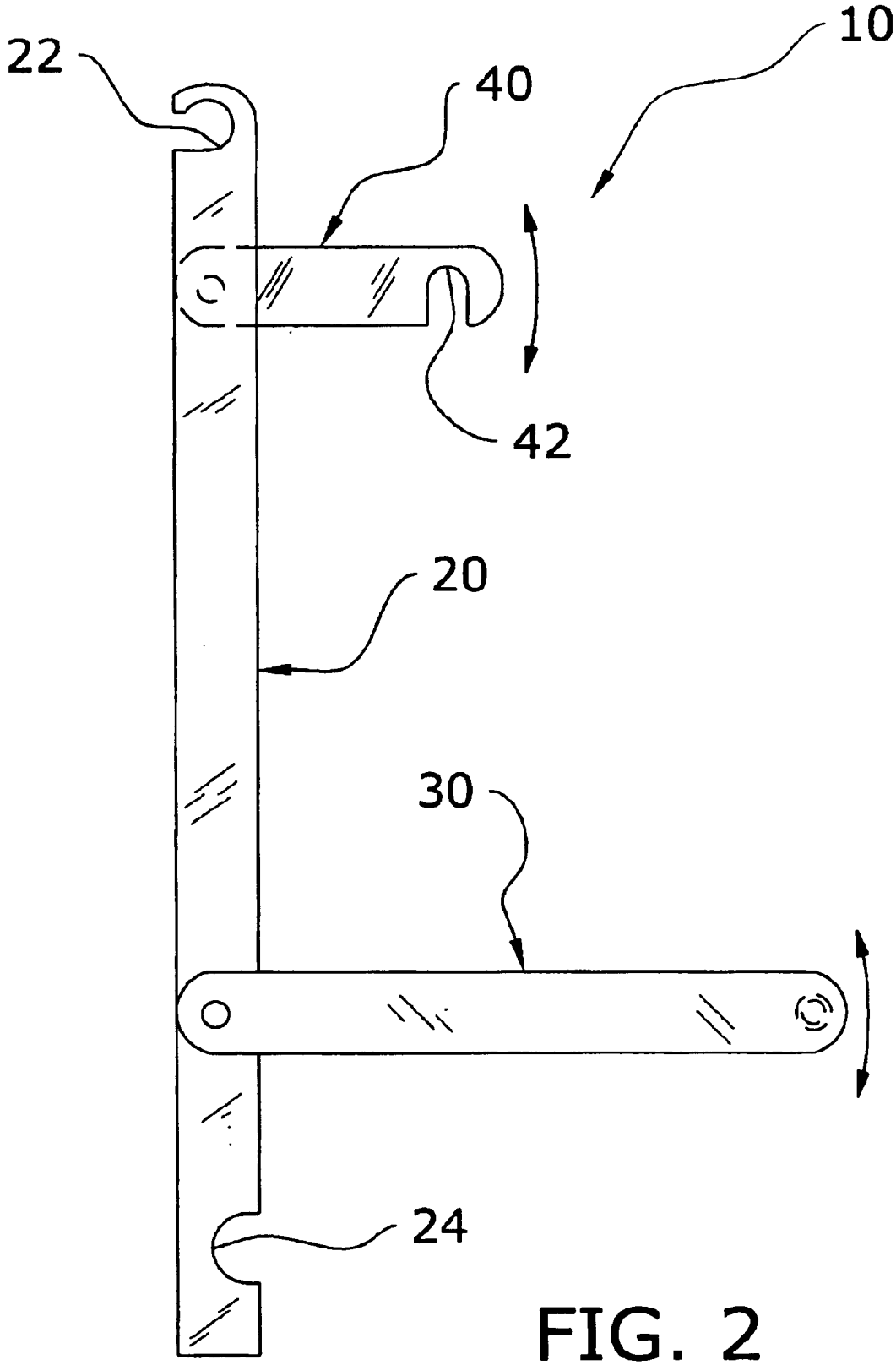
FIG. 2 is a side view of the present invention.
Figure 3:
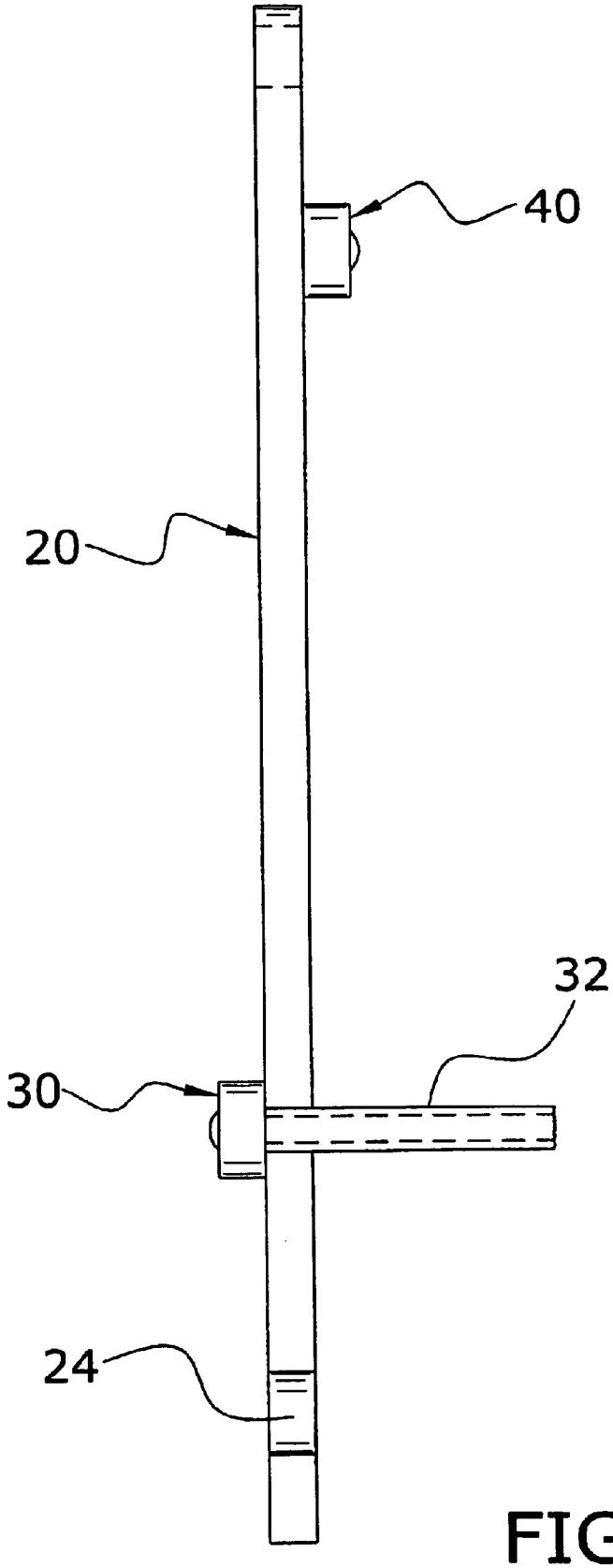
FIG. 3 is a front view of the present invention.

The main member 20 is comprised of an elongate rigid structure as illustrated in FIGS. 2 and 3 of the drawings. The main member 20 is preferably comprised of a flat structure, however various other structures may be utilized.

The main member 20 includes a first cutout 22 capable of engaging a first fastener 16 of a motor mount 14 and a second cutout 24 for engaging a second fastener 17 of a motor mount 14 as best illustrated in FIGS. 1 and 2 of the drawings. The first cutout 22 is preferably facing opposite of the second cutout 24 as shown in FIG. 2 of the drawings, however the first cutout 22 may face in the same direction as the second cutout 24.

The first arm 30 is pivotally attached to the main member 20 as shown in FIGS. 1 through 3 of the drawings. The first arm 30 is preferably pivotally attached between a first end and a center point of the main member 20. The first arm 30 is preferably comprised of an elongate straight structure as shown in FIG. 2 of the drawings.

An engaging tube 32 extends substantially transversely from a distal portion of the first arm 30 as best illustrated in FIG. 3 of the drawings. The engaging tube 32 has a distal open end for removably receiving and engaging a first locking pin 18 of a motor mount 14 by surrounding the first locking pin 18.

A second arm 40 is pivotally attached to the main member 20 opposite of the first arm 30 as shown in FIGS. 1 through 3 of the drawings. The second arm 40 is pivotally attached between a second end and a center point of the main member 20 as best illustrated in FIG. 2 of the drawings. The second arm 40 preferably includes an arm cutout 42 for engaging a second locking pin 18 of a motor mount 14. The first arm 30 is preferably longer than the second arm 40 as best illustrated in FIG. 2 of the drawings.

The first cutout 22 and the arm cutout 42 preferably face opposite one another when the second arm 40 is aligned parallel with the main member 20 extending towards the distal end of the main member 20. The first cutout 22, the second cutout 24 and the arm cutout 42 preferably have a U-shaped or C-shaped structure for engaging either the locking pins 18 or fasteners 16, 17 of the motor mount 14.

Figure 4:
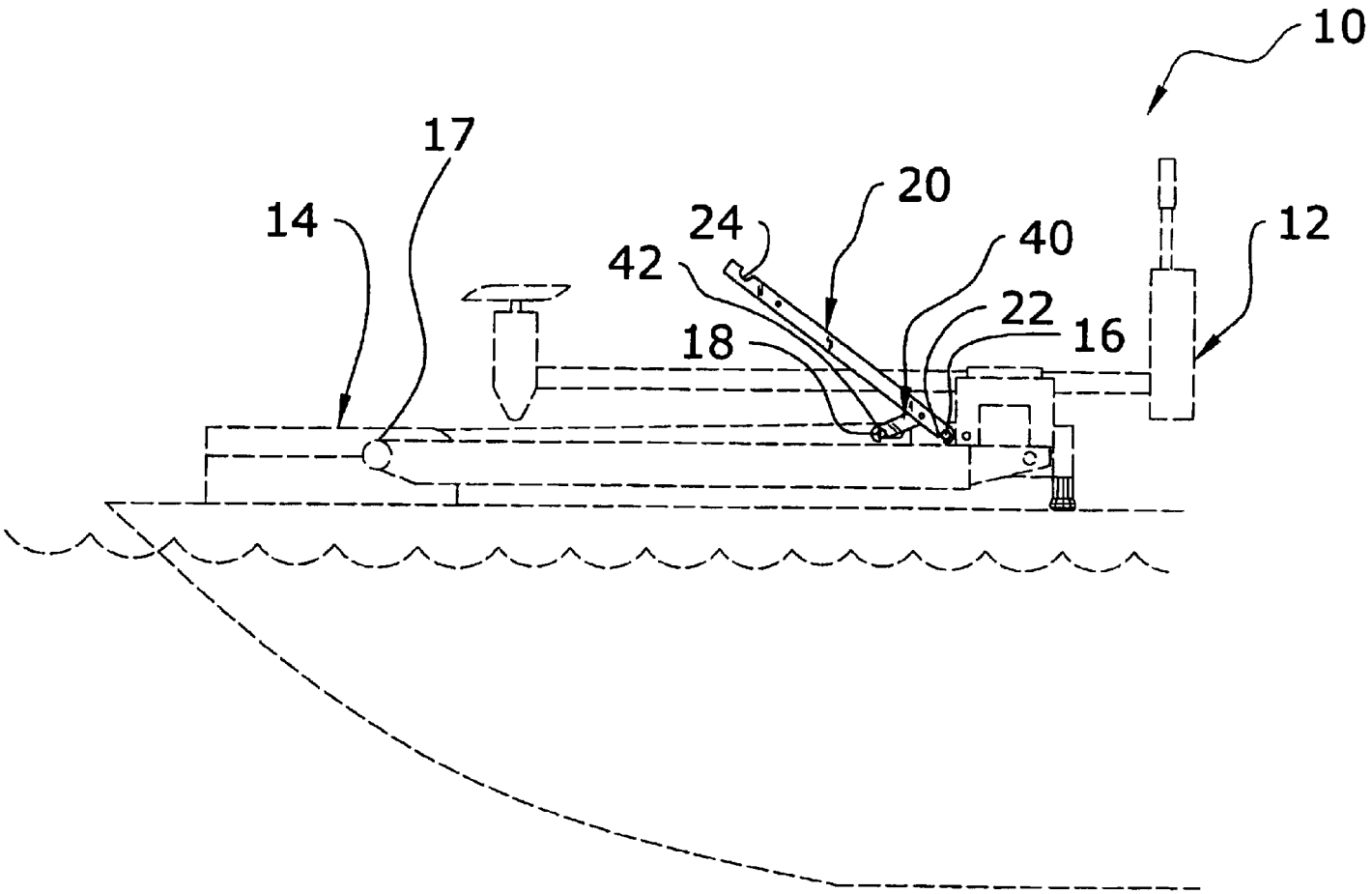
FIG. 4 is a side view of the present invention engaging a locking pin of a trolling motor mount.
Figure 6:
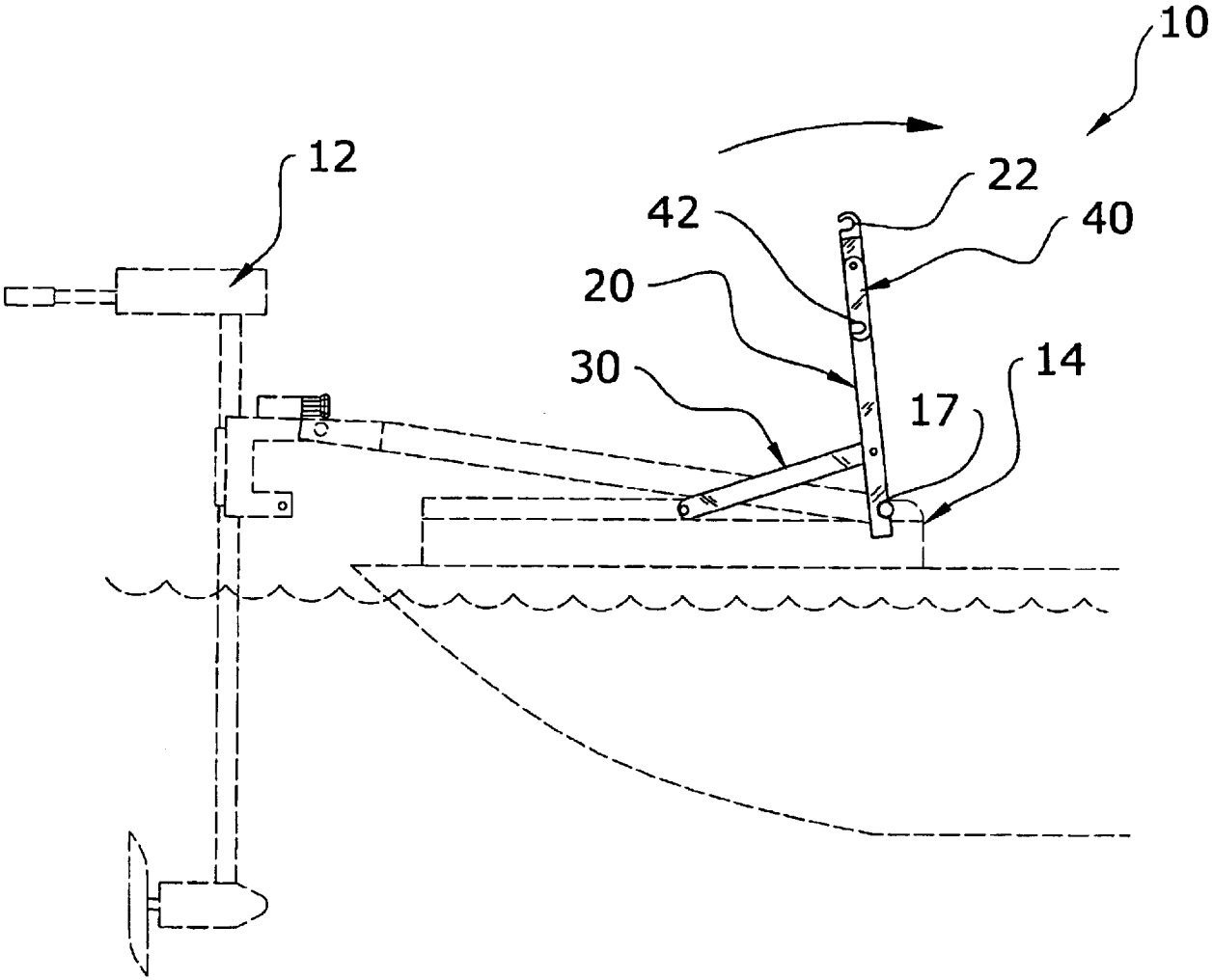
FIG. 6 is a side view of the present invention engaging the locking pin thereby releasing the locking pin to allow the trolling motor to be raised out of the water.

If the user desires to raise the motor mount 14 supporting a trolling motor 12 to a raised or stored position, the user utilizes the second cutout 24 to engage the second fastener 17 (the pivotal arm connection fastener) of the motor mount 14 while positioned within the lowered or operating position as shown in FIG. 6 of the drawings. The user also positions the engaging tube 32 of the first arm 30 to engage the locking pin (not shown) of the motor mount 14 as shown in FIG. 6 of the drawings. The user then rotates the main member 20 thereby releasing the locking pin (not shown) which allows the motor mount 14 to pivot to the raised or stored position as shown in FIG. 4 of the drawings. The first locking pin (not shown) is thereafter released back into the locked position.

Figure 5:
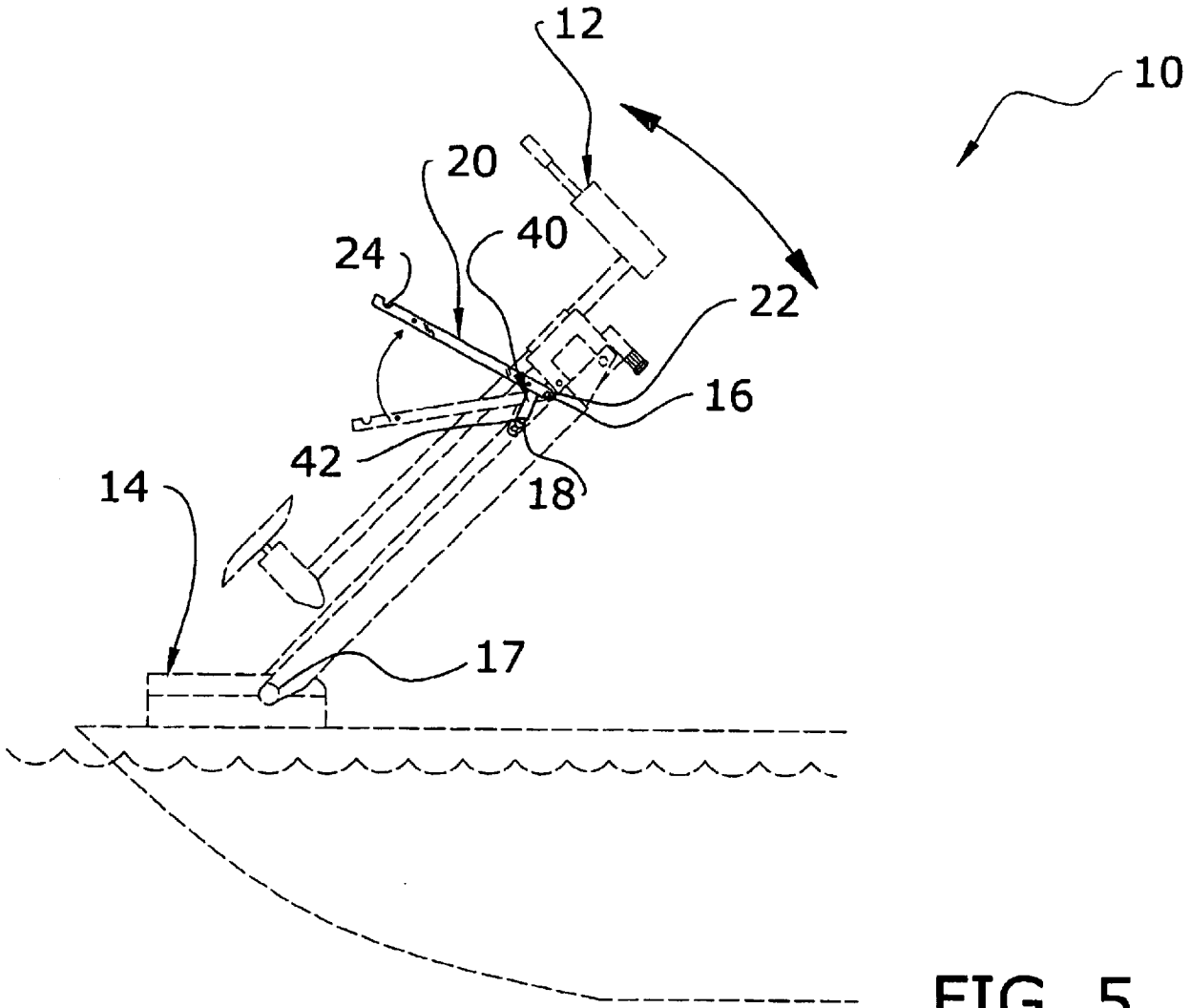
FIG. 5 is a side view of the present invention manipulating the locking pin thereby releasing the locking pin to allow the trolling motor to be lowered into the water.

If the user desires to lower the motor mount 14 from a raised or stored position, the user utilizes the first cutout 22 to engage the first fastener 16 of the motor mount 14 while positioned within the raised or stored position as shown in FIG. 4 of the drawings. The user also positions the arm cutout 42 of the second arm 40 catchably about the second locking pin 18 of the motor mount 14 as shown in FIG. 4 of the drawings. The user then rotates the main member 20 thereby releasing the locking pin 18 which allows the motor mount 14 to pivot to the lowered or operating position as shown in FIGS. 4 through 6 of the drawings. The locking pin 18 is thereafter released back into the locked position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

| | |
|---|---|
| ☐ ENVIRONMENTAL ELEMENTS | ☐ 40. Second Arm |
| ☐ | ☐ 41. |
| ☐ | ☐ 42. Arm Cutout |
| ☐ | ☐ 43. |
| ☐ | ☐ 44. |
| ☐ | ☐ 45. |
| ☐ | ☐ 46. |
| ☐ | ☐ 47. |
| ☐ | ☐ 48. |
| ☐ | ☐ 49. |
| ☐ 10. Trolling Motor Mount Tool | ☐ 50. |

-continued

| | |
|---|---|
| ☐ 11. | ☐ 51. |
| ☐ 12. Trolling Motor | ☐ 52. |
| ☐ 13. | ☐ 53. |
| ☐ 14. Motor Mount | ☐ 54. |
| ☐ 15. | ☐ 55. |
| ☐ 16. First Fastener | ☐ 56. |
| ☐ 17. Second Fastener | ☐ 57. |
| ☐ 18. Locking Pin | ☐ 58. |
| ☐ 19. | ☐ 59. |
| ☐ 20. Main Member | ☐ 60. |
| ☐ 21. | ☐ 61. |
| ☐ 22. First Cutout | ☐ 62. |
| ☐ 23. | ☐ 63. |
| ☐ 24. Second Cutout | ☐ 64. |
| ☐ 25. | ☐ 65. |
| ☐ 26. | ☐ 66. |
| ☐ 27. | ☐ 67. |
| ☐ 28. | ☐ 68. |
| ☐ 29. | ☐ 69. |
| ☐ 30. First Arm | ☐ 70. |
| ☐ 31. | ☐ 71. |
| ☐ 32. Engaging Tube | ☐ 72. |
| ☐ 33. | ☐ 73. |
| ☐ 34. | ☐ 74. |
| ☐ 35. | ☐ 75. |
| ☐ 36. | ☐ 76. |
| ☐ 37. | ☐ 77. |
| ☐ 38. | ☐ 78. |
| ☐ 39. | ☐ 79. |

I claim:

1. A trolling motor mount tool for releasing a motor mount for a trolling motor from a locked position, comprising:

a main member having an elongated straight structure having a first end and a second end;

a first cutout and a second cutout extending into opposite ends and opposite sides of said main member;

a first arm pivotally attached to said main member between said first end and a center point of said main member;

an engaging tube extending substantially transversely from a distal portion of said first arm, wherein said engaging tube is engageable with a locking pin of the motor mount; and a second arm pivotally attached to said main member between said second end and said center point of said main member, wherein said second arm includes an arm cutout wherein said arm cutout is engageable with a locking pin of a motor mount for a trolling motor;

wherein said first cutout and said arm cutout face opposite one another when said second arm is aligned parallel with said main member extending towards the second end of said main member.

2. The trolling motor mount tool of claim 1, wherein said main member is comprised of a rigid material.

3. The trolling motor mount tool of claim 1, wherein said main member is comprised of a flat structure.

4. The trolling motor mount tool of claim 1, wherein said first arm is longer than said second arm.

5. A trolling motor mount tool for releasing a motor mount for a trolling motor from a locked position, comprising:

a main member having a first cutout capable of engaging a first fastener of the motor mount and a second cutout for engaging a second fastener of the motor mount;

a first arm pivotally attached to said main member, wherein said first arm is pivotally attached between a first end and a center point of said main member;

an engaging tube extending substantially transversely from a distal portion of said first arm, wherein said engaging tube has a distal open end for engaging a first locking pin of the motor mount; and a second arm pivotally attached to said main member, wherein said second arm includes an arm cutout for engaging a second locking pin of the motor mount, wherein said second arm is pivotally attached between a second end and said center point of said main member.

6. The trolling motor mount tool of claim 5, wherein said main member is comprised of an elongate structure.

7. The trolling motor mount tool of claim 6, wherein said main member is comprised of a rigid material.

8. The trolling motor mount tool of claim 6, wherein said main member is comprised of a straight structure.

9. The trolling motor mount tool of claim 6, wherein said main member is comprised of a flat structure.

10. The trolling motor mount tool of claim 6, wherein said first cutout and said arm cutout face opposite one another when said second arm is aligned parallel with said main member extending towards the second end of said main member.

11. The trolling motor mount tool of claim 5, wherein said first arm is longer than said second arm.

12. A method of raising a trolling motor mount from a locked position utilizing a tool comprising a main member having a first cutout and a second cutout, a first arm pivotally attached to said main member, an engaging tube extending substantially transversely from a distal portion of said first arm, and a second arm pivotally attached to said main member, wherein said second arm includes an arm cutout, said method comprising the steps of:

positioning said second cutout about a pivotal arm connection fastener of said trolling motor mount;

positioning said engaging tube upon a locking pin of said trolling motor mount; and rotating said main member to release said locking pin thereby allowing said trolling motor mount to pivot to a raised position.

* * * * *